United States Patent [19]

Wachi

[11] Patent Number: 4,561,337

[45] Date of Patent: Dec. 31, 1985

[54] DIGITAL ELECTRONIC MUSICAL INSTRUMENT OF PITCH SYNCHRONOUS SAMPLING TYPE

[75] Inventor: Masatada Wachi, Hamamatsu, Japan

[73] Assignee: Nippon Gakki Seizo Kabushiki Kaisha, Hamamatsu, Japan

[21] Appl. No.: 611,367

[22] Filed: May 16, 1984

[30] Foreign Application Priority Data

Jun. 8, 1983 [JP] Japan ..... 58-100840

[51] Int. Cl.[4] ..... G10H 1/00

[52] U.S. Cl. ..... 84/1.01; 328/14; 328/16

[58] Field of Search ..... 84/1.01, DIG. 9; 364/484, 721; 328/14, 16, 30

[56] References Cited

U.S. PATENT DOCUMENTS

| | | | |
|---|---|---|---|
| 3,743,755 | 7/1973 | Watson | 84/1.01 |
| 4,258,602 | 3/1981 | Niimi et al. | 84/1.01 |
| 4,345,500 | 8/1982 | Alonso et al. | 328/16 |
| 4,383,462 | 5/1983 | Nagai et al. | 84/1.26 |

*Primary Examiner*—Forester W. Isen

*Attorney, Agent, or Firm*—Spensley Horn Jubas & Lubitz

[57] ABSTRACT

A digital electronic musical instrument is constituted by detector, a phase angle, information generator and a musical tone generator. The detector detects an end portion of a period of a musical tone to be produced. The phase angle information generator repetitively generates phase angle information representing an instantaneous phase angle of the musical tone during from start to end of the period of the musical tone in response to the detection of the end portion of the period. The musical tone generator synthesizes the musical tone in accordance with the phase angle information. Operations of the detector, phase angle information generator and tone generator are performed on the basis of clock pulses having a predetermined frequency which is an integer multiple of a fundamental frequency of the musical tone to be produced, thereby realizing the so-called pitch synchronous system and simplifying the construction of the musical instrument.

10 Claims, 2 Drawing Figures

DIGITAL ELECTRONIC MUSICAL INSTRUMENT OF PITCH SYNCHRONOUS SAMPLING TYPE

BACKGROUND OF THE INVENTION

The present invention relates to an electronic musical instrument and particularly an electronic musical instrument utilizing a musical tone synthesis system of a pitch synchronous sampling type.

In conventional digital electronic musical instruments, a musical tone waveform amplitude is sampled at given sampling intervals to synthesize a tone waveform. The musical tone synthesis systems adopting sampling include (1) a pitch asynchronous technique and (2) a pitch synchronous technique. According to the former technique, an input signal is sampled at a given sampling frequency irrespective of a frequency of a musical tone to be produced. Therefore, in order to accurately produce pitches or waveforms of musical tones all having different pitches, number of amplitude data samples are required for one period of the musical tone, or a very high sampling frequency must be set. Even if the sampling timing can be applied to any phase angle, a great amount of amplitude data samples must be prepared to respectively correspond to the small phase angles, or the high sampling frequency is used to set a timing of change in the readout address. However when a great number of amplitude data samples are prepared, the required capacity of a waveform data memory is increased. In particular, when different waveform data for a number of different tone colors are stored in the memory, the required capacity becomes greatly increased, resulting in high cost and a large size. In addition, when the sampling frequency is increased too much, one-cycle sampling time of digital/analog (D/A) conversion of the musical tone signal corresponding to one-sampling time must be shortened, so that an expensive high-speed D/A converter must be used. However, such a D/A converter is expensive and has technical limitations in high-speed operation. While according to the latter technique, that is, a pitch synchronous technique, the sampling frequency is synchronous with a frequency of a musical tone to be produced. Although the problem raised by the pitch synchronous technique is relatively improved, jitter noises (an external noise components other than the musical tone signal) included in the musical tone signal to be produced is a significant problem. A countermeasure must be taken to eliminate the jitter. On the other hand, in the conventional pitch synchronous technique, sampling is performed at different sampling frequencies respectively corresponding to different pitches (different notes). When polyphonic tones are to be produced, tone generators are arranged to generate the respective single tones paralelly. As a result, polyphonic tones cannot be produced in accordance with a time division scheme. In addition to this disadvantage, the apparatus as a whole becomes large in size.

SUMMARY OF THE INVENTION

Therefore, it is a main object to provide an improved a digital electronic musical instrument of a pitch synchronous (sampling) type. It is a further object to provide a digital electronic musical instrument having advantages of the pitch asynchronous system and the pitch synchronous system.

A digital electronic musical instrument having a musical tone synthesis system of a pitch synchronous sampling type comprising; sampling clock pulse generating means for generating sampling clock pulses having a predetermined frequency which is an integer multiple of a fundamental frequency of a musical tone to be produced, detecting means for detecting an end portion of a period of said musical tone, phase angle information generating means for repetitively generating phase angle information corresponding to a phase angle of said musical tone during from start to end of the period of said musical tone in response to the detection of said end portion of the period, said phase angle being specified by the generation of said clock pulses, and tone generating means for producing a musical tone in accordance with said phase angle information.

DESCRIPTION OF THE PREFERRED EMBODIMENTS

Figure 1:
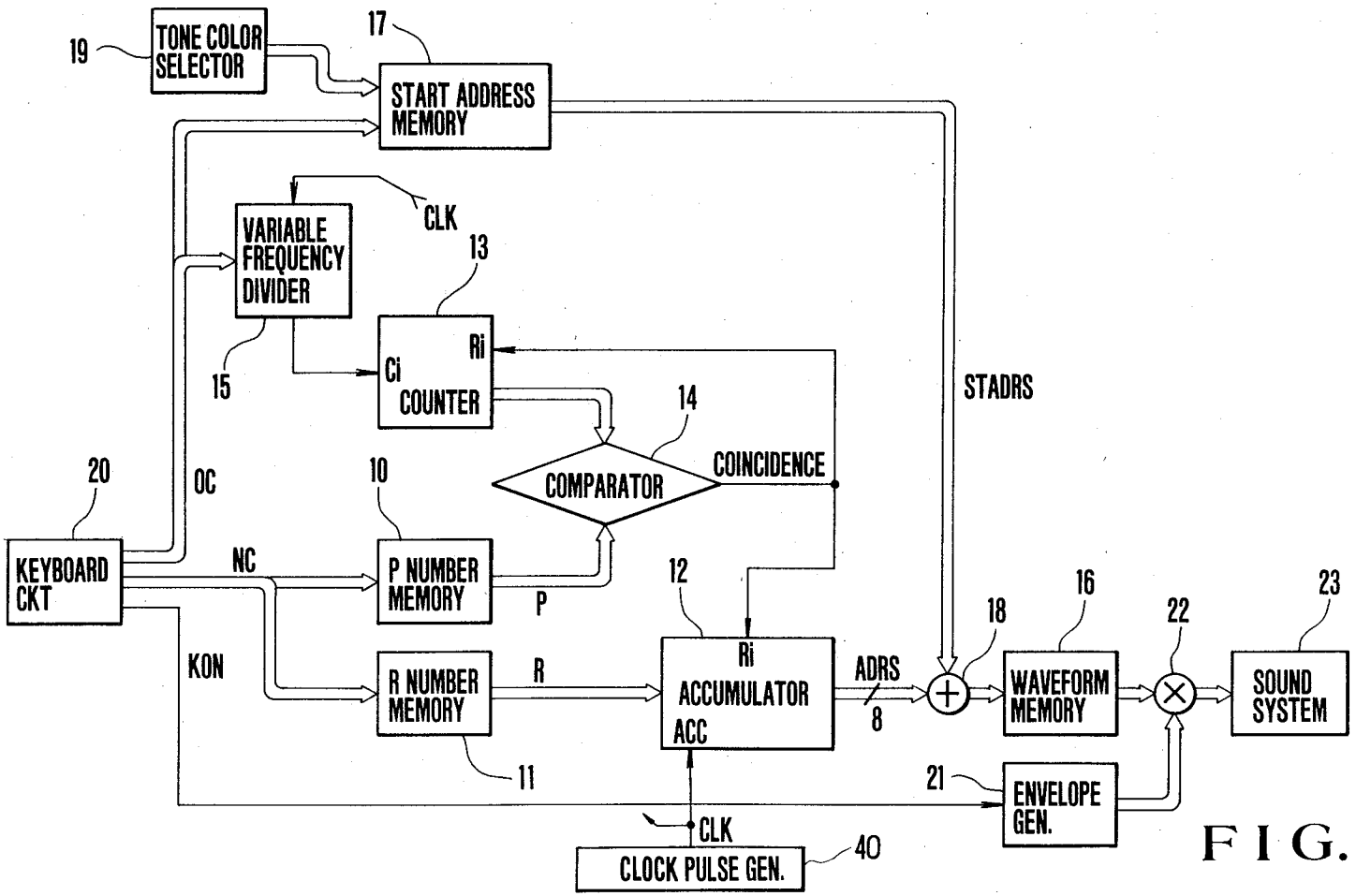
FIG. 1 is a block diagram showing an embodiment of a digital electronic musical instrument according to the present invention.

Referring to FIG. 1, a P number memory 10 stores a number representing the number of sampling periods of much one period of a musical tone to be produced consists. The sampling period is the period of sampling clock pulses CLK generated from a clock pulse generator 24. Such an integer is called a "P number" hereinafter. The P number memory 10 prestores P numbers respectively corresponding to notes C# to C of the highest octave under the condition that the sampling frequency is constant. It is known that the ratio of the normal pitch of a note to that of another note is irrational number. Strictly speaking, therefore, P numbers also are expressed as irrational numbers. However, according to the present invention, the irrational P numbers are rounded to the nearest integers. When P number is excessively small, the error of pitch corresponding to the P number is large from temperament scale. While, when P number is excessively large, signal processing becomes complex. In this embodiment, the P numbers respectively corresponding to different notes are given in column B in the following table. Column A shows the normal pitches of notes C#6 to C7 (the highest octave) on the temperament scale.

TABLE 1

| Note | (A) Pitches on temperament scale (Hz) | (B) P number | (C) Pitch error (cent) | (D) Quasi-R number | (E) R number (= 32/p number) |
|---|---|---|---|---|---|
| C# | 1,108.731 | 967 | −0.8 | 1,084 | 0.03309 . . . |
| D | 1,174.659 | 912 | 0.5 | 1,150 | 0.0278 . . . |
| D# | 1,244.508 | 861 | 0.2 | 1,218 | 0.03716 . . . |
| E | 1,318.510 | 813 | −0.5 | 1,290 | 0.0393 . . . |
| F | 1,396.913 | 767 | 0.3 | 1,367 | 0.04172 . . . |
| F# | 1,479.978 | 724 | 0.2 | 1,448 | 0.04419 . . . |
| G | 1,567.982 | 683 | 1.1 | 1,535 | 0.0468 . . . |
| G# | 1,661.219 | 645 | 0.2 | 1,626 | 0.04961 . . . |
| A | 1,760.000 | 609 | −0.4 | 1,722 | 0.0525 . . . |
| A# | 1,864.655 | 575 | −0.9 | 1,824 | 0.0556 . . . |
| B | 1,975.533 | 542 | 1.4 | 1,935 | 0.0590 . . . |
| C | 2,093.005 | 512 | 0 | 2,048 | 0.0625 |

In the above table, first the P number and the sampling frequency of the highest note C7 are determined. And then, P numbers of other notes are determined in accordance with the determined sampling frequency. Since the normal pitch of note C7 is 2093.005 Hz, the above sampling frequency is given to be 1.07161856 MHz (=2093.005 Hz×512) when "512" is set as the P number of note C7. The sampling frequency is thus determined as described above. The P numbers of other notes B6 to C#6 are obtained by dividing the sampling frequency of 1.07161856 MHz by the corresponding normal pitches respectively. The resultant quotients are rounded to the nearest integers, respectively. These integers are given to be the P numbers in column B in Table 1. The pitches defined by the corresponding P numbers in a manner to be described later are respectively deviated from the normal pitches since rounding is performed as described above. These pitch errors of the notes are represented in units of cents, as shown in column C in Table 1. Since note C7 is the reference, its pitch error is zero. The pitch errors of other notes fall within or about one cent. No probelm occurs in practice.

An R number memory 11 stores the number corresponding to the amount of phase shift of a musical tone to be produced for one sampling period. Such number is referred to as an "R number" hereinafter. The R number memory 11 prestores R numbers which respectively correspond to notes C# to C of the highest octave. The R number read out from the R number memory 11 is repeatedly added (or substracted) in an accumulator 12 in response to sampling clock pulses CLK (having a frequency of 1.07161856 MHz). The content of the accumulator 12 is sequentially incremented at a rate corresponding to the R number every sampling period. The resultant data of the accumulator 12 is outputted as address data ADRS of a waveform memory 16, which represents the present phase angle of a musical tone to be produced. More specifically, predetermined upper bits of the accumulated value of the accumulator 12 are used as the address data ADRS. The waveform memory 16 stores a waveform common to all notes (C# to C) for each octave in the form of sampled amplitude values whose number is predetermined in accordance with octave. In the highest octave, the number is 12. The address data ADRS is used to access each of the 32 sampled amplitude values in the case of the highest octave. The number of sampled amplitude values composing the one-period waveform for each octave is called a memory size of the octave. The values of the R number to be stored in the R number memory 11 are determined in accordance with the relationship between the memory size and the P numbers. In other words, each R number is a quotient obtained by dividing the memory size by the corresponding P number. When the R number is accumulated by a number of the corresponding P number, the number of addresses for the one-period waveform the memory size. Therefore, a total phase shift representating the accumulated P number corresponds to one period (phase angle of $2\pi$) when sampling pulses of the number corresponding to the P number occur.

The R numbers respectively corresponding to the P numbers are illustrated in column E in Table 1 under the condition that the memory size is 32. The R number of note C7 which is used as the reference for determining the corresponding P number can be obtained by division to have four decimal places. Other R numbers cannot be so obtained and upon division are given as infinite decimals, respectively. In column D in Table 1, the R numbers are multiplied by $2^{15}$, and the fractional parts of the resultant products are rounded to the nearest integers, respectively. These integers are as quasi-R numbers. Alternatively, when each R number is expressed as a binary number, the weighting of the binary number is shifted by 15-bits toward the upper bit side, thereby obtaining the quasi-R number, as shown in column D. The two types of quasi-R numbers obtained. The R number is theoretically given to be a value in column E. When the R number is expressed as finite binary bits, the corresponding decimal value is as given in column D. Therefore, it is considered that the R numbers respectively consist of decimal numbers in column D and are stored as binary data in the R number memory 11.

When the R number of note C7 as the reference for determining the P number is accumulated by P number times, the accumulated value becomes "32" ($32\times2^{15}$ when a decimal point is positioned, in the same manner as the R number in column D in Table 1) corresponding to the memory size. No remainder can be left. Therefore, the period representing a change in accumulated value (address data) in the accumulator 12 is completely matched with the sampling clock pulse timing. However, this does not occur for other notes B to C#. The R number used in practical operation does not coincide with the theoretical value (irrational number in column E in Table 1) but is a finite rounded number. Errors is also accumulated by the accumulator 12. Therefore, even if the R number is accumulated by the P number times, the accumulated value does not completely coincide with the memory size, and a remainder is left. When this remainder is accumulated, the one cycle of the address data ADRS (one period of the waveform of the musical tone) will not coincide with the P number times the sampling period. The one cycle is thus not completely synchronized with the sampling clock pulse timing. In order to solve the above problem according to the present invention, the sampling clock pulses are sequentially counted. Every time the count of the counter 13 reaches the P number, the accumulator 12 is reset to be a predetermined value (typically zero). In other words, the remainder stored in the accumulator 12 is cleared every time sampling clock pulses of the number corresponding to the P number have generated. The cycle of the address data ADRS is thus forcibly synchronized with the sampling clock pulse timing.

A counter 13 and a comparator 14 are arranged to control the resetting operation of the accumulator 12. As for the highest octave, the sampling clock pulse CLK are supplied without dividing operation to a count input terminal Ci of the counter 13 through a variable frequency divider 15. The counter 13 sequentially counts the sampling clock pulses. The comparator 14 compares the P number read out from the P number memory 10 with the count of the counter 13. When a coincidence is established, the comparator 14 generates a reset pulse which is supplied to reset input terminals Ri of the accumulator 12 and the counter 13.

In this embodiment, a waveform memory 16 is used as a musical tone signal generator for generating waveform data of musical tones which have different tone colors respectively. For example, the waveform memory 16 stores musical sound waveforms in the form of amplitude sample data each tone waveform comprising 480 words. The memory 16 has a capacity corresponding to "480 words×the number of the stored tone waveforms". Each tone waveform comprises one-period waveforms for respective octaves. More specifically, the highest octave one-period waveform has 32 words, and the next and subsequent lower octave one-period waveforms have 64, 128 and 256 words, respectively. The memory size to store one-period waveforms for four octaves necessitates 480 words for each musical tone.

All the words stored in the waveform memory 16 are accessed by specific absolute addresses, respectively. The memory area of the memory 16 is specified in accordance with the tone color of the musical tone to be produced and the octave to which this tone belongs. The data stored in the specified memory area are repeatedly read out therefrom in accordance with the output address data ADRS of the accumulator 12. More particularly, the head absolute address of the memory area is accessed by a start address STADRS generated from a start address memory 17. The 8-bit address data ADRS is supplied from the accumulator 12 to an adder 18. The adder 18 adds the output address data ADRS to the start address data STADRS with a weighting of the lower 8 bits. The above-mentioned readout operation is controlled such that sum data from the adder 18 is used as an absolute address accessing the memory 16.

As described above, the memory sizes for the octaves (the number of addresses for the one-period waveform) differ from each other, so that the modulo number of the address data ADRS obtained by the accumulator 12 must be switched in accordance with the octaves. More specifically, the modulo numbers of the address data ADRS must be 32 for the highest octave, 64 for the second highest octave, 128 for the third highest octave, and 256 for the fourth highest octave. This indicates that weighting of the address data ADRS with respect to the phase angles differs in accordance with the octaves. The modulo number switching for the different octaves can be easily realized such that the accumulator 12 is properly reset in accordance with the P numbers. The P numbers of the notes of the highest octave have already been given in Table 1. The P numbers for the next and subsequent lower octaves are two, four and eight times that for the highest octave, respectively (since the periods of the musical tones for the next and subsequent lower octaves are two, four and eight times that for the highest octave, the P numbers for the lower octaves increases). Therefore, the reset intervals of the accumulator 12 are multiplied by two, four or eight times in accordance with the given octaves. On the other hand, the accumulator 12 accumulates the R number corresponding to the musical tone in response to the sampling clock pulses CLK irrespective of the octaves. The modulo numbers of the resultant address data ADRS are switched to the "32", "64", "128" or "256" in accordance with the given octaves.

The P number memory 10 stores P numbers of notes of the highest octave. P numbers of notes of other octaves are not stored in the P number memory 10. However, processing can be performed as if all the P numbers of notes of all octaves are prepared by adjusting counting operation of the sampling clock pulses CLK. More specifically, the frequency of sampling clock CLK is divided by the variable frequency divider 15 in accordance with the octave to which the musical tone to be produced belongs (the frequency division ratios are 1 for the highest octave and $\frac{1}{2}$, $\frac{1}{4}$ and $\frac{1}{8}$ respectively for the lower octaves). The frequency-divided output is supplied as a count clock to the counter 13, so that an incrementing ratio of the counter 13 is changed. For example, when the counter 13 counts the sampling clock pulse CLK for note C6 at a rate of $\frac{1}{2}$, the count of the counter 13 becomes "512" when it actually counts 1024 sampling clock pulses. This count corresponds to the P number "512" of note C7 which is read out from the memory 10. The comparator 14 generates a reset pulse every time 1024 sampling clock pulses corresponding to the true P number "1024" of note C6 are counted in this manner.

For example, a keyboard is used to specify a musical tone to be produced. A keyboard circuit 20 generates an octave code OC representing a octave to which a depressed key belongs, a note code NC representing a note of the depressed key, and a key-on signal KON representing whether or not the key is depressed. The P number and the R number which correspond to the note are respectively read out from the P number memory 10 and the R number memory 11 in response to the note code NC. The frequency division ratio of the variable frequency divider 15 is determined in accordance with the octave code OC. The start address data STADRS is read out from the start address memory 17 in accordance with the octave code OC and tone selection data read out from a tone color selector 19. The key-on signal KON is supplied to an envelope generator 21 which then generates an envelope signal. The musical tone waveform signal repeatedly read out from the waveform memory 16 in response to the address data ADRS supplied from the accumulator 12 is supplied to a multiplier 22. The multiplier 22 multiplies the musical tone waveform signal with the envelope signal generated by the envelope generator 21. The musical tone waveform signal with an envelope appears at a sound system 23.

Figure 2:
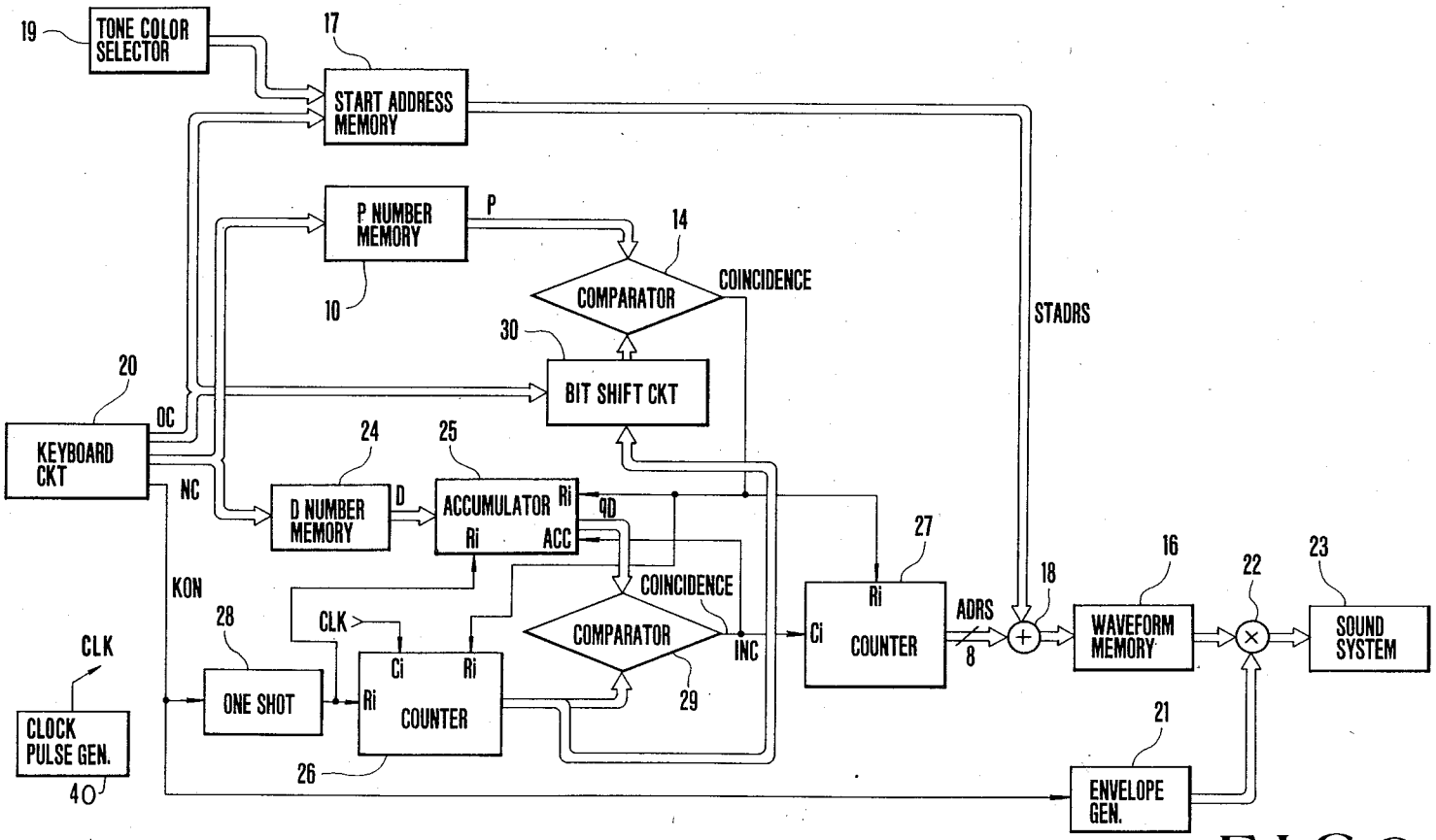
FIG. 2 is a block diagram showing another embodiment of a digital electronic musical instrument according to the present invention.

FIG. 2 is a digital electronic musical instrument according to another embodiment of the present invention, wherein the address data ADRS is generated in accordance with a different method from that shown in FIG. 1, and a parameter called a D number is used in place of the R number. The same reference numerals are used in FIG. 2 to denote the same circuits and signals as in FIG. 1, and a detailed description thereof will be omitted.

A D number memory 24 stores the number of sampling periods corresponding to time necessary for advancing address by one when sequentially reading out the sampled amplitude values of the stored musical tone waveform in the waveform memory 16, that is, corresponding to a minimum unit phase shift of a musical tone to be produced. Such number is called a "D number" hereinafter. The D number memory 24 prestores D number of notes C# to C of the highest octave. The D number memory 24 is accessed in accordance with a note code NC of note to be produced irrespective of octave to which the note belongs.

The D numbers stored in the D number memory 24 are determined in relation with the memory size and the P numbers, and each is an inverse number of the corresponding R number. A quotient obtained by dividing the P number by the memory size (the number of addresses for one period of the stored musical tone waveform ) is the D number. When the P number is divided by the memory size, the number of sampling clock pulses for one address (corresponding to the minimum unit phase shift of the waveform read out from the memory 16) is obtained and the number is the D number.

The D numbers of notes C# to C are calculated on the basis of the memory size "32" of the highest octave in the following manner:

TABLE 2

| Note | C# | D | D# | E | F | F# | G | G# | A | A# | B | C |
|---|---|---|---|---|---|---|---|---|---|---|---|---|
| D number | 30 | 29 | 27 | 25 | 24 | 23 | 21 | 20 | 19 | 18 | 17 | 16 |

The D number of note C or the reference for determining the P number is simply divided to be "16". However, D numbers of other notes cannot be so divided and are rounded to obtain integers, respectively. In the same manner as for the R numbers, errors occur in an accumulator 25 and counters 26 and 27 during operation. The accumulator 25 and the counters 26 and 27 are reset in response to generation of sampling clock pulses of the number corresponds to the P number in the same manner as for the R numbers. The repetition frequency of the address data ADRS (i.e., the pitch of the musical tone to be produced) is synchronized with the sampling frequency. It should be noted that an error due to rounding can be decreased when the significant digits of the D number are increased. The quotient obtained by dividing the P number by a divisor of $32/2^n$ (n: positive integer) such as 16 or 8 may be used as a quasi-D number, so that the significant digits of the D number can be increased within the limit of the hardware configuration. In this manner, the D number is obtained by dividing the P number by 32, 16, 8 or the like. Alternatively, data obtained by shifting the P number toward the lower bits can be used as the D number. In this case, the D number memory 24 can be omitted.

The counter 26 is reset by an output from a one-shot circuit 28 which is responsive to a key-on signal KON, and sequentially counts sampling clock pulses CLK. A count of the counter 26 is compared by a comparator 29 with an accumulated value qD generated by the accumulator 25. When a coincidence is established in the comparator 29, an increment pulse INC is generated by the comparator 29. The accumulator 25 accumulates the D number sequentially read out from the D number memory 24 in response to the increment pulse INC supplied from the comparator 29 to an accumulation timing clock input terminal ACC of the accumulator 25. The accumulator 25 is reset together with the counter 26 in response to the output from the one-shot circuit 28 immediately after the key is depressed. The output qD from the accumulator 25 which is just reset is the same value as the D number data read out from the D number memory 24. Thereafter, when the counter 26 counts the sampling clock pulses of the number corresponding to the D number, the coincidence output from the comparator 29 is set to be logic "1", so that the increment pulse INC is supplied to the terminal ACC of the accumulator 25. The D number is accumulated once by the accumulator 25, and the output qD becomes 2D. The counter 26 continues to count the sampling clock pulses CLK of the number exceeding the D number. When the count of the counter 26 has reached 2D, the comparator 29 generates another increment pulse INC. In this manner, every time a number of sampling clock pulses CLK corresponding to the D number are counted, the increment pulse INC is generated and the content of the accumulator 25 is increased by D.

On the other hand, the increment pulse INC is also supplied to the count input terminal Ci of the counter 27 used for generating the address data. Every time the increment pulse INC is supplied to the count input terminal Ci, the counter 27 is incremented by one. An output from the counter 27 is supplied as the address data ADRS to an adder 18 and hence a waveform memory 16. The counter 27 counts one every time the counter 26 counts sampling clock pulses CLK of the number corresponding to the D numbers. Thus, the address data ADRS is sequentially incremented.

A bit shift circuit 30 shifts the bits of the output from the counter 26 in accordance with an octave code OC. A bit-shifted output is supplied to a comparator 14. The count output of the highest octave is not subjected to bit shifted and is supplied directly to the comparator 14. The count output of the lower octave is shifted to the lower bit by the number corresponding to the octave and are supplied to the comparator 14. The count output from the counter 26 indicates the number of sampling clock pulses CLK. When the count output coincides with the P number, the comparator 14 generates a reset pulse which is then supplied to reset input terminals Ri of the accumulator 25 and the counters 26 and 27. The reason why the bit shift circuit 30 is arranged is the same as the reason why the variable frequency divider 15 is arranged in the electronic musical instrument of FIG. 1. That is, the modulo numbers of the counter 27 and hence the address data ADRS are switched to "32", "64", "128" and "256" in accordance with the corresponding octaves. For example, note C7 is not bit shifted. When the count of the counter 26 has reached "512" which corresponds to the P number "512", the counter 27 is reset, so that the address data ADRS changes with modulo 32. However, note C6 is shifted to the lower bit by one bit. When the count of the counter 26 has reached "1024" (the P number of note C6) which corresponds to the P number "512" of note C, the address data ADRS from the counter 27 changes with modulo 64.

In the above embodiments, the present invention is applied to monophonic type electronic musical instruments. However, the present invention can also be applied to an electronic musical instrument of polyphonic construction. In this case, a known key assigner may be arranged in association with the keyboard circuit 20. In the above embodiments, one period of the waveform of the note C7 is sampled with 512 samples, and the amplitude data for one address are sampled with 16 samples. Since one sample is assigned to at least one address, a margin of 15 samples is left. Therefore, time-division processing for producing 16 musical tones can be performed by using the sampling clock pulses CLK used in the above embodiments.

In each of the above embodiments, different memory areas in the waveform memory 16 are provided according to octaves. However, a maximum size memory (e.g., 256 addresses) can be commonly used for the respective octaves, and the read addresses random-accessed in accordance with the given octaves. The number of addresses for the one-period waveform may change to 32, 64, 128 or 256.

The means for generating the musical tone waveform in accordance with the address data ADRS corresponding to the phase angle is not limited to the waveform memory 16. However, any musical tone waveform generating means may be used.

The circuit elements of FIGS. 1 and 2 may be modified and changed within the spirit and scope of the present invention.

According to the present invention, a musical tone having the normal pitch whose period substantially integer multiple of the sampling period can be generated. Various drawbacks of the conventional pitch asynchronous sampling system are eliminated. In addition, since the musical tone can be synthesized without changing sampling period in accordance with pitch of a tone to be produced, time division processing of polyphonic tones can be performed. Therefore, the drawbacks of the conventional pitch synchronous sampling system are also eliminated.

What is claimed is:

1. A digital electronic musical instrument having a musical tone synthesis system of a pitch synchronous sampling type, comprising:

sampling clock pulse generating means for generating sampling clock pulses having a predetermined frequency which is common to a plurality of musical tones and integer multiples of fundamental frequencies of said musical tones;

period data memory means for storing period data representing periods of said respective musical tones;

time measuring means for measuring time on the basis of said sampling clock pulses;

detecting means for repetitively detecting the coincidence between the measured time and the period data of each musical tone to be produced and outputting a coincidence signal;

phase angle information generating means responsive to said sampling clock pulses for repetitively generating cyclical phase angle information corresponding to progressing phase angle values of said each musical tone during from start to end of the period of said musical tone, the repetition cycle of said information being equal to the period of time between successive occurrences of said coincidence signal; and tone generating means for producing a musical tone in accordance with said phase angle information.

2. A digital electronic musical instrument according to claim 1, wherein said tone generating means comprises;

waveform memory means for storing a period of waveform corresponding to said musical tone in the form of plurality of sampled values.

3. A digital electronic musical instrument according to claim 1, wherein said period data is a first period number defined as a number of sampling periods of which a period of said musical tone consists, the sampling period being defined as a period of said sampling clock pulses; and wherein said time measuring means comprises counter means for counting said sampling clock pulses, the count of said counter means representing the measured time.

4. A digital electronic musical instrument according to claim 1, wherein said phase angle information generating means comprises:

phase angle number memory means for storing a phase angle number corresponding to a phase angle of said musical tone which advances during a sampling period defined as a period of said sampling clock pulses; and accumulator means for accumulating said phase angle number read out from said angle number memory every time said sampling clock pulses generating means generates a said sampling pulse, the output of said accumulator being outputted to said musical tone generating means as said phase angle information.

5. A digital electronic musical instrument according to claim 2, wherein said phase angle information generating means comprises:

second period number memory means for storing a second period number defined as the number of sampling periods in the time interval between consecutive sample values among said plurality of sample values, the sampling period being defined as a period of said sampling clock pulses; and first counter means for counting said sampling clock pulses;

coincidence detecting means for producing a coincidence signal when the count of said first counter coincides with an accumulated value of said second period number; and second counter means for counting said coincidence signal and for outputting the count to said tone generating means as said phase angle information.

6. A digital electronic musical instrument according to claim 3, which further comprises:

first period number memory means for storing said first period number corresponding to a note belonging to a specified octave, said phase angle information generating means further comprising modifying means for modifying said phase angle information, in accordance with the difference between said specified octave and a octave to which said musical tone belongs.

7. A digital electronic musical instrument according to claim 1, which further comprises;

a keyboard circuit means for designating a pitch of said musical tone.

8. In a digital electronic musical instrument of the type in which a musical tone is generated in accordance with provided phase angle information, the improvement for providing pitch synchronization, comprising:

accumulator means for accumulating, at a fixed clock rate, a phase angle value which is different in accordance with the note name of said musical tone, the accumulated phase angle values corresponding to said phase angle information from which said musical tone is generated, and means for resetting said accumulator means to a fixed value each time the accumulator has been incremented a certain number of times, said certain number representing the number of sampling periods required for production of one period of the musical tone being generated.

9. An electronic musical instrument according to claim 8 wherein said means for resetting comprises:

a memory storing the number of required sampling periods for each note name, and comparator means for comparing the number of times which said accumulator means has been incremented with the stored number for the note name of the musical tone being generated, said resetting occurring when equivalence is established by said comparator means.

10. In a digital electronic musical instrument of the type in which a musical tone is generated in accordance with provided phase angle information, the improvement for providing pitch synchronous sampling, comprising:

phase angle information producing means for producing, in accordance with a fixed clock rate and by accumulation of a phase angle value which is different in accordance with the note name of said musical tone, incrementally changing phase angle information from which said musical tone is generated, and means for resetting said phase angle information producing means to a fixed value each time said produced phase angle information has been incrementally changed a certain number of times, said certain number corresponding to the number of sampling periods required for production of one period of the musical tone being generated.

* * * * *